US005825291A

United States Patent [19]

Platt et al.

[11] Patent Number: 5,825,291

[45] Date of Patent: Oct. 20, 1998

[54] ELECTRONIC ARTICLE SURVEILLANCE SYSTEM

[75] Inventors: Victor Platt, Ronkonkoma; Christopher Reinard Paul, Bayport; Thomas A. Nicolette, Centerport; Peter Y. Zhou, Smithtown, all of N.Y.

[73] Assignee: Sentry Technology Corporation, Hauppauge, N.Y.

[21] Appl. No.: 827,041

[22] Filed: Mar. 25, 1997

[51] Int. Cl.[6] ..... G08B 13/14

[52] U.S. Cl. ..... 340/572; 340/571; 343/742; 343/741; 343/867

[58] Field of Search ..... 340/572, 571; 343/742, 842, 867, 744, 841, 853, 741

[56] References Cited

U.S. PATENT DOCUMENTS

| | | | |
|---|---|---|---|
| 3,493,955 | 2/1970 | Minasy . | |
| 3,500,373 | 3/1970 | Minasy . | |
| 3,696,379 | 10/1972 | Minasy . | |
| 3,828,337 | 8/1974 | Lichtblau | 340/572 |
| 3,868,669 | 2/1975 | Minasy . | |
| 4,016,553 | 4/1977 | Novikoff et al. . | |
| 4,095,214 | 6/1978 | Minasy | 340/572 |
| 4,135,184 | 1/1979 | Pruzick . | |
| 4,243,980 | 1/1981 | Lichtblau | 340/572 |
| 4,251,808 | 2/1981 | Lichtblau | 340/572 |
| 4,260,990 | 4/1981 | Lichtblau | 340/572 |
| 5,061,941 | 10/1991 | Lizzi et al. | 340/572 |
| 5,103,209 | 4/1992 | Lizzi et al. | 340/572 |
| 5,103,235 | 4/1992 | Clemens | 340/572 |
| 5,367,291 | 11/1994 | Fockens | 340/572 |
| 5,373,301 | 12/1994 | Bowers et al. | 340/572 |
| 5,627,516 | 5/1997 | Balch et al. | 340/572 |
| 5,661,470 | 8/1997 | Karr | 340/572 |

FOREIGN PATENT DOCUMENTS 763681 5/1934 France .

*Primary Examiner*—Nina Tong
*Attorney, Agent, or Firm*—Fitzpatrick, Cella, Harper & Scinto

[57] ABSTRACT

An electronic article surveillance system capable of reliable operation at high frequencies such as about 8 MHz, has an arrangement of transmitter and receiver antennas each lying in a flat, horizontal plane in substantial alignment with each other, with the receiver antenna positioned at the floor of a passageway at an interrogation zone and the transmitter antenna positioned overhead. Each antenna takes the form of a pair of parallel-connected, coplanar loops with the transmitter-connected loops being positioned such that electrical current flows around each loop in parallel in the same direction (a ++ configuration) and in the receiver antenna electrical current flows around each loop in parallel in mutually opposite directions (a +− configuration). The antennas are approximately of the same size and overall configuration, and they are positioned in substantial alignment so that the currents induced in the receiver antenna by the field from the transmitter antenna will effectively cancel. Current variations caused by the passage of a target through the interrogation zone will be greater in some of the conductors of the receiver antenna than in others and so can be detected.

6 Claims, 2 Drawing Sheets

ELECTRONIC ARTICLE SURVEILLANCE SYSTEM

CROSS REFERENCE TO RELATED APPLICATIONS

This application claims the benefit of the filing date of copending Provisional Application Ser. No. 60/016,078 filed Apr. 10, 1996.

BACKGROUND OF THE INVENTION

1. Field of the Invention

This inventiony relates to electronic systems for detecting the unauthorized passage of protected articles through an passageway, and more particularly to such a system which is usable at a very high frequency, such as about 8 megahertz, without requiring the use of side-by-side antennas.

2. Description of Related Background Art

In U.S. Pat. No. 3,500,373 there is disclosed an electronic theft detection system for protecting articles of merchandise in a retail store. Each article to be protected is provided with a tag or label (hereinafter called a "target") which contains a concealed resonant electrical circuit. Transmitter and receiver antennas are provided at an egress facility such as a doorway, and the transmitter antenna is energized to generate an electromagnetic field in the vicinity of the doorway which varies cyclically in frequency, e.g., the frequency may shift over a range from 0.8 to 1.2 megahertz at a rate of 500 hertz. When a protected article, carrying a concealed resonant circuit tuned to resonate at a frequency within the sweep range, is carried into the electromagnetic field, the resonant circuit reacts with the field and produces a characteristic response. The exit region is continuously monitored for the occurrence of this distinctive response, and when it is detected an alarm is sounded.

U.S. Pats. Nos. 3,696,379, 3,868,669 and 4,016,553 show various additional features, adaptations and improvements to the basic system of U.S. Pat. No. 3,500,373.

U.S. Pat. No. 3,493,955 shows an electronic theft detection system which utilizes an electronic transponder circuit as the target on protected articles. This circuit responds to an electromagnetic interrogation signal at one frequency and retransmits at another frequency. Transmitter antennas are provided on the floor and one side of an egress passageway and a receiver antenna is provided on the opposite side of the passageway.

French Pat. No. 763,681 to P. A. Picard shows a similar detection system, and in one embodiment there is shown a balanced receiver antenna comprising a double loop in the form of a figure eight. The aforementioned U.S. Pat. No. 4,016,553 also employs a balanced receiver antenna in the detection of resonant electrical circuits.

U.S. Pat. No. 4,135,184 discloses an electronic theft detection system suitable for use at very wide egress passageways. The antennas are arranged to lie in horizontal planes, with either the transmitter or the receiver antenna at the floor and the other disposed above the passageway. As many antennas as necessary to span the entire passageway are provided, without the need for any equipment to be disposed in the passageway itself.

While many prior art systems contemplate the use of reusable tags or labels (tags and labels will be collectively termed "targets" herein) that are removed from the article by the store clerk upon purchase of the article, it is desirable also to be able to provide targets that, upon purchase of the article, can be permanently disabled by the store clerk and discarded. To this end, it is desired to make the targets as inexpensive, and therefore as small, as possible.

As a practical matter, reducing the size of the target results in reducing the values of the electrical inductance and capacitance which make up the resonant circuit. As is known to those in the art, the effect of this is an increase in the resonant frequency of the circuit. Accordingly, it has become desirable to provide an electronic article surveillance system that can be operated reliably with very small targets, at higher frequencies than have commonly been used hitherto.

The increase in resonant frequency of the target, however, introduces another problem, because at the higher frequency, it is necessary for the resonant frequency of the antennas also to be raised correspondingly to the target frequency. The capacitance of the transmitter antenna cannot practically be reduced below a certain value, however, and the inventor has therefore found it advantageous to adopt the approach of lowering the inductance of the antenna so that the product of the inductance and the capacitance, which defines the antenna's resonant frequency, will be within the required bounds, as described below.

Furthermore, once a set of transmitter and receiver antennas operable at the desired frequency is constructed and tested, the inventor has found that often there is interference of a magnitude sufficient to render the system impossible or at least impractical to use. The inventor has determined that the source of this interference is typically the presence of electrically conductive members in the floor (for example, steel reinforcing rods in concrete floors).

SUMMARY OF THE INVENTION

The present invention solves the above described problems by providing in a resonant circuit type theft detection system, a novel arrangement of transmitter and receiver antennas each lying in a flat, horizontal plane in substantial alignment with each other, with the receiver antenna positioned at the floor of a passageway at an interrogation zone and the transmitter (or interrogation) antenna positioned overhead, so that a person who walks through the interrogation zone passes between the antennas. Each antenna comprises a plurality of conductors electrically connected together in parallel to form a closed circuit with the transmitter and the receiver respectively. According to the invention, each antenna has a pair of parallel-connected, coplanar loops with the transmitter-connected loops positioned such that electrical current flows around each loop in parallel in the same direction (a ++ configuration) and the receiver antenna loops arranged such that electrical current flows around each loop in parallel in mutually opposite directions (a +− configuration). The antennas are approximately of the same size and overall configuration, and they are positioned in substantial alignment so that the currents induced in the receiver antenna by the fields from the transmitter antenna will effectively cancel. The current variations caused by the passage of a target through the interrogation zone, however, will be greater in some of the conductors of the receiver antenna than in others so that cancellation of those current variations will not occur, and those variations will be detected. In the preferred embodiment, each loop of the receiver antenna is constructed as a twisted wire pair, one wire of the pair being grounded to act as an electrostatic shield.

There have thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the purposes of this invention. It is important, therefore, that this disclosure be regarded as including such equivalent arrangements as do not depart from the spirit and scope of the invention.

BRIEF DESCRIPTION OF THE DRAWINGS

The preferred embodiment of the invention is described below in detail for purposes of illustration and description, and is shown in the accompanying drawings forming a part of the specification, wherein.

DETAILED DESCRIPTION OF THE PREFERRED EMBODIMENTS

Figure 1:
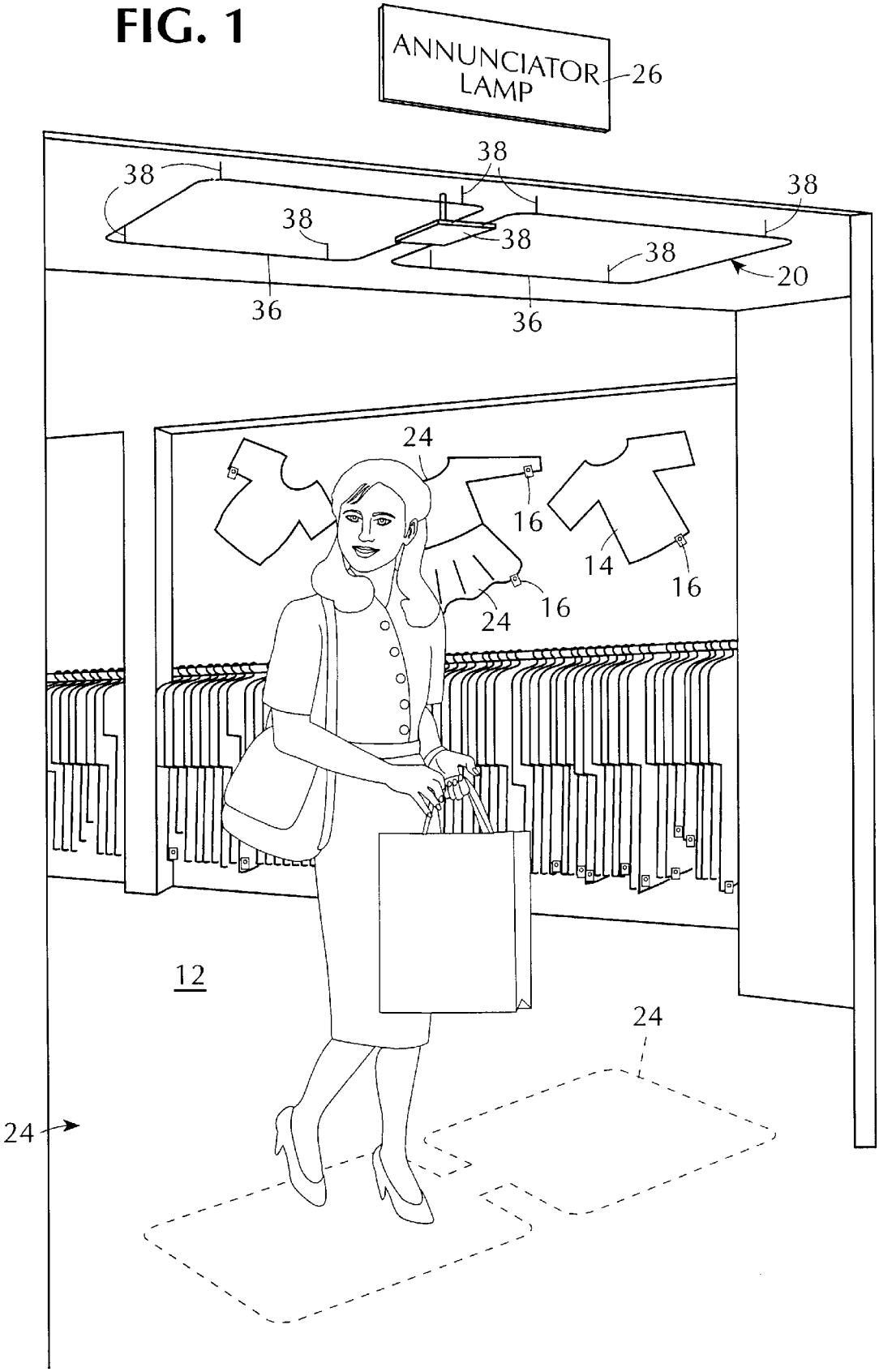
FIG. 1 is a perspective view showing a store exit provided with an antenna arrangement for an electronic theft detection system according to the preferred embodiment of the present invention.

In FIG. 1 there is shown a protected area 12, such as the interior of a store, or a particular department within a store, in which articles of merchandise 14, such as clothing, are displayed for inspection prior to sale. Each article of merchandise is provided with a target 16 which carries within it a resonant electrical circuit. The target 16 cannot be removed from the article 14 except by an authorized person, such as a sales clerk, when a legitimate purchase is made. The fastening means for securing the target 16 to the article 14 is not part of this invention and will not be described herein. Upon purchase of the article 14, the store clerk either removes the target 16, or destroys it. Removal is performed using a special tool for the purpose. Some examples of such tools are shown and described in U.S. Pat. No. 3,628,267 and in U.S. Pat. No. 3,911,534. Destruction of the target 16 is effected for example by exposing it at short range to a strong source of RF energy at its resonant frequency, to cause the capacitor to break down.

Customers and potential customers may enter into and exit from the protected area 12 via a passageway such as an open arch, as shown, or a doorway. A receiver antenna 18 is positioned below the passageway, substantially at floor level, and a transmitter antenna 20 is positioned overhead, so that customers pass between the antennas 18, 20 as they enter and exit through the passageway. The antennas 18, 20 are connected to an electrical detection system having transmitter circuitry and receiver circuitry. (Except as otherwise described below, the transmitter and receiver circuitry is as in systems now in use and is housed in an equipment box 22 shown in FIG. 2.) The transmitter circuitry causes the transmitter antenna 20 to generate an electromagnetic interrogation field throughout an interrogation zone 24 extending crossways of and a short distance along the passageway. When an article 14 is carried through the interrogation zone 24 with a target 16 attached to it the resonant circuit within the target 16 interacts with the electromagnetic interrogation field. The electromagnetic responses which result from this interaction produce electrical signals in the receiver antenna 18, and these signals are used to produce an audio or visual alarm. By way of example an annunciator lamp 26 may be provided above the passageway as shown in FIG. 1; and the detection system may be arranged to light this lamp 26 for the production of a visual alarm. Other alarm arrangements may be utilized as desired.

When an article 14 is actually purchased, the sales clerk either disables the resonant circuit or removes the target 16 with its resonant circuit so that when the article 14 is brought through the interrogation zone 24 it will not interact with the interrogation field and no alarm will be produced.

Figure 2:
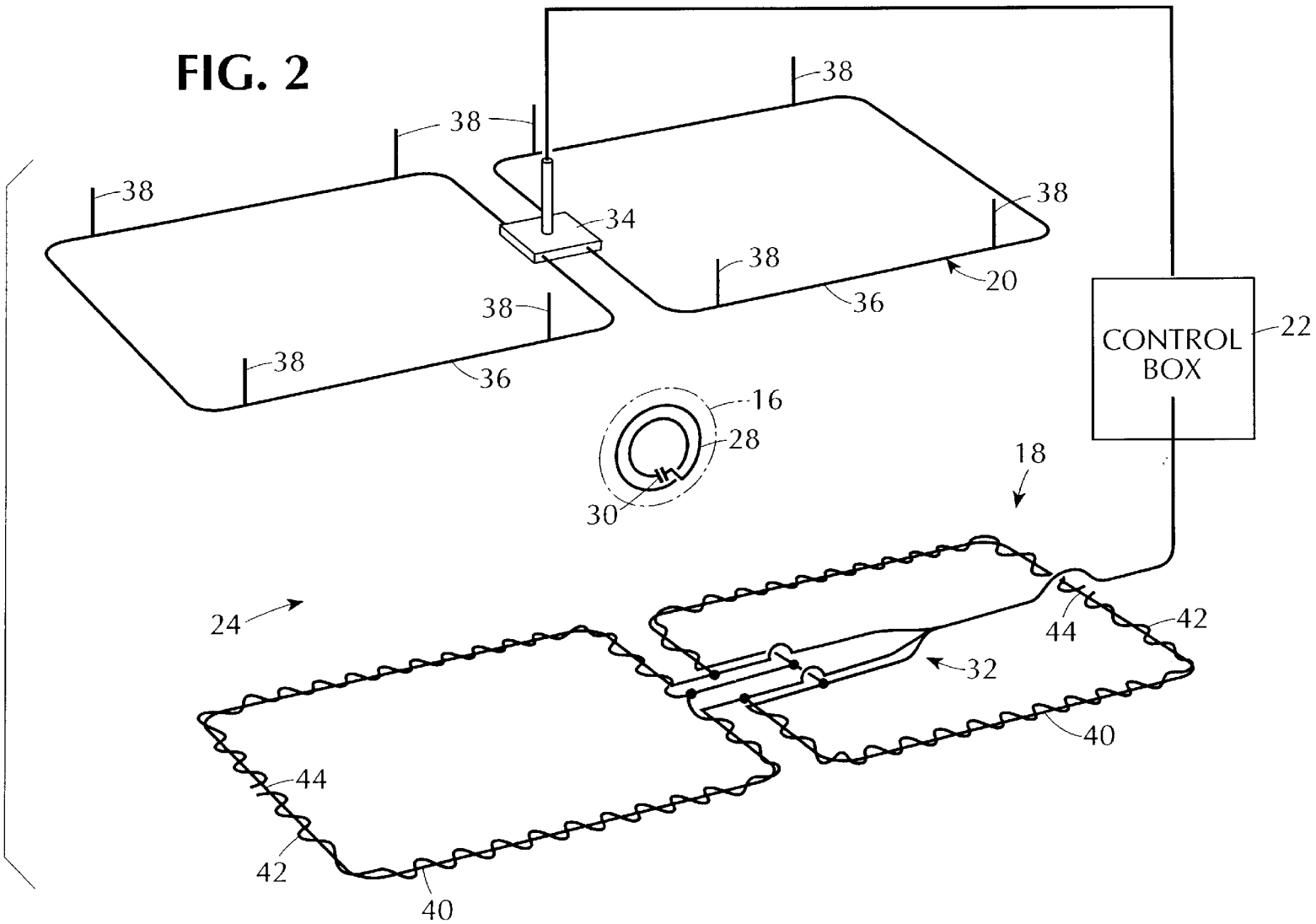
FIG. 2 is a perspective view showing the transmitter and receiver antenna arrangements of FIG. 1, with schematic representations of a target in the interrogation zone between them and of a unit containing the electrical circuitry.

The target 16 is shown in phantom outline between the antennas 18, 20 in FIG. 2; and the resonant electrical circuit embedded in the target 16 is shown to comprise a coil 28 and a capacitor 30 connected in parallel with each other. The coil 28 and capacitor 30 are tuned to resonate at a particular frequency within the frequency range of the electrical signals produced by the transmitter. The resonant electrical circuit produces a characteristic electromagnetic response in the presence of the swept frequency electromagnetic field produced by the transmitter antenna 20, and this response produces corresponding electrical current variations in the receiver antenna 18.

The receiver antenna 18 is connected via receiver leads 32 to a detector which detects the electrical current variations produced in the receiver antenna 18 by the resonant electrical circuit. Filter and signal processing circuits are provided to separate the detected current variations having the distinctive signal characteristic corresponding to the presence of a resonant circuit in the passageway between the antennas 18, 20 from other detected current variations caused by noise and extraneous electrical disturbances. The filtering and signal processing circuits are connected to the alarm 26, which they actuate when such separation takes place. The electrical components of the detection system itself are located in the unit identified in FIG. 2 as the control box 22; since their structure and arrangement do not constitute the novel feature of this invention, and are largely the same as in currently-used systems, those circuits are not shown in detail.

Similarly, the transmitter circuitry is largely the same as what is used in conventional systems except for including an oscillator whose output frequency is swept 500 times a second through a bandwidth of 1.4 MHz about a center frequency of 8.2 MHz, rather than through a narrower bandwidth about a center frequency of about 2 MHz, as in prior systems. These differences in the circuitry are well within the ability of a circuit designer of ordinary skill and do not require further detail to enable practice of the invention.

To minimize capacitance in the transmitter circuit, however, the transmitter antenna drivers are provided in the overhead transmitter antenna unit itself (one driver for both loops), in a box 34 in which the ends of the antenna loops 36 are received, and directly drive the metal pipes which form the loops 36. This feature represents a departure from conventional systems, which normally house the drivers in the same equipment box with the other circuitry, mounted on a wall at some convenient location near the interrogation zone.

As indicated above, a swept frequency theft detection system for detecting the presence of resonant electrical circuits on articles of merchandise is known in the prior art. The present invention, however, provides novel arrangements whereby this type of theft detection system can be used effectively with very small targets having high resonant frequencies such as 8.2 megahertz.

As shown in FIG. 2, the antennas 18, 20 lie in respective flat horizontal planes at the floor and overhead of the passageway and thus no portion of the theft detection system obstructs the sides of the passageway. In this fashion the antenna arrangements may be largely or completely hidden from view, with the receiver antenna 18 embedded in the floor or lying thereon and covered by a mat and the transmitter antenna 20 hidden by the ceiling, or suspended from the ceiling in view by acrylic rods 38 or the like, as in FIGS. 1 and 2.

As described above, each antenna takes the form of a pair of parallel-connected, coplanar loops. The transmitter-connected loops 36 are arranged such that electrical current flows around each loop 36 in parallel in the same direction (a ++ configuration), while in the receiver antenna 18 electrical current flows around each loop 40 in parallel in mutually opposite directions a +− configuration). Preferably the two loops of each of the antennas are rectangular in configuration.

In the preferred embodiment the transmitter antenna loops 36 are made of ⅜-inch chromium-covered copper pipe, and have the same size and shape. When installed in place the transmitter antenna 20 has an overall length of six to eight feet and a width of three feet. The pipes of the antenna loops 36 are received in the box 34 housing the drivers by means of plastic bushings (not shown), about which the pipes can rotate.

The receiver antenna 18 is similar in shape to the transmitter antenna 20, and has an overall length of six to eight feet in the preferred embodiment, but a width of only 2.5 feet. The two loops 40 of the receiver antenna 18 are arranged directly below and in substantial alignment with those of the transmitter antenna 20, so that the currents induced in the receiver antenna 18 by the field from the transmitter antenna 20, produce fields that will effectively cancel each other. In this embodiment the equipment box 22 may be up to 20 feet from the receiver antenna 18 and up to 40 feet from the transmitter antenna 20.

One result of the above-described arrangement of the antennas is that the field in a region nearer the receiver antenna 18 (say, the lower half or so of the interrogation zone 24) is relatively low in strength, so that the disturbances in the field produced by a target in the field are large compared to the field produced by the antennas 18, 20 themselves. The low field strength makes it easy to detect those disturbances reliably, thus facilitating the detection of such targets, and at the same time reducing the likelihood of any false positives (erroneous indication that a target is present in the interrogation zone when none is actually there).

As shown in FIG. 2, each loop 40 of the receiver antenna 18 is constructed of a twisted pair of wires rather than of pipe, in the preferred embodiment. In each loop 40, one wire 42 of the pair is grounded, thus acting as an electrostatic shield for the signals in the other wire 44. The grounded wires 42 are each broken at a point halfway around the loop from where the other wires 44 are connected to the signal take-out leads 32.

Finally, it should be noted that the above-described construction of the antennas has an additional benefit. In current (lower-frequency) systems, the packing of the antennas so that no breakage will occur can be difficult, because of their size. In the present invention, in contrast, the antennas can be easily folded, reducing the overall size of the product and greatly facilitating its packaging for shipment. Because the pipes of the transmitter antenna 20 are rotatable about the plastic bushings which accommodate them in the transmitter driver box 34, the two loops 36 of the transmitter antenna 20 can be rotated down from the configuration shown in FIG. 2, where they are coplanar, to one in which the two loops 36 are parallel. In the latter position, the overall dimensions of the transmitter antenna 20 are much less than when the unit is deployed, with a maximum measurement of around three or four feet versus one of six or eight feet. This feature greatly facilitates packing, and reduces the likelihood of damage in transit. The receiver antenna 18, made of twisted wires 42, 44, can simply be folded into a compact arrangement for shipping.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended thereto.

What is claimed and desired to be secured by Letters Patent is:

1. An electronic article surveillance system for producing an alarm signal when an article of merchandise having a responder attached thereto is carried through an exit passageway, said system comprising an interrogation signal generator connected via a first pair of terminals to a transmitter antenna for generating electromagnetic waves in an interrogation zone and a receiver connected via a second pair of terminals to a receiver antenna for receiving electromagnetic waves present in said interrogation zone, said receiver including signal processing circuits for detecting predetermined characteristics in the received waves to generate an alarm, said transmitter antenna extending in a horizontal plane above said passageway and said receiver antenna extending in a horizontal plane below said passageway, each of said antennas being formed of a plurality of loops which extend over different, non-overlapping areas in a common plane and which are electrically connected in parallel to its respective pair of terminals, the loops of said receiver antenna being connected such that currents flow in parallel therein in mutually opposite directions and the loops of said transmitter antenna being connected such that currents flow in parallel; therein in the same direction.

2. An electronic article surveillance system according to claim 1 wherein said one of said antennas is formed of two loops and wherein its respective pair of terminals is located between said loops.

3. An electronic article surveillance system according to claim 2 wherein each loop of said one of said antennas is mounted on a member in such manner as to be rotatable about that member about a line that extends between said loops.

4. An electronic article surveillance system according to claim 1 wherein said transmitter antenna and said receiver antenna are each formed of two parallel connected loops, each of said loops comprising a single turn.

5. An electronic article surveillance system according to claim 1 wherein said one of said antennas is said transmitter antenna, each of the loops of which is a single turn, each loop being formed of a metal pipe.

6. An electronic article surveillance system according to claim 1 wherein said one of said antennas is said receiver antenna, each of the loops of which is a single turn, each half of each loop being twisted along its length with a separate grounded conductive wire.

* * * * *

UNITED STATES PATENT AND TRADEMARK OFFICE

CERTIFICATE OF CORRECTION

PATENT NO. : 5,825,291

DATED : October 20, 1998

INVENTOR(S) : VICTOR PLATT, ET AL.

It is certified that error appears in the above-identified patent and that said Letters Patent is hereby corrected as shown below:

COLUMN 1

Line 13, "inventiony" should read --invention--;

Line 14, "an" should read --a--;

COLUMN 17

Line 5, "a +-" should read --(a + - --.

Signed and Sealed this

Sixteenth Day of March, 1999

*Attest:*

*Attesting Officer*

Q. TODD DICKINSON

*Acting Commissioner of Patents and Trademarks*